US007197983B2

(12) United States Patent
Barth et al.

(10) Patent No.: US 7,197,983 B2
(45) Date of Patent: Apr. 3, 2007

(54) MECHANO-ELECTRICAL FUSE FOR A HAND GRENADE

(75) Inventors: Norbert Barth, Nohfelden/Eisen (DE); Michael Hahn, Nürnberg (DE); Dietmar Kugler, Ottensoos (DE); Wolfgang von Entress-Fürsteneck, Altdorf/Rasch (DE); Thomas Arm, Nonnweiler (DE); Erwin Wrobel, Pluwig (DE)

(73) Assignee: Diehl Munitionssysteme GmbH & Co., Röthenbach (DE)

( * ) Notice: Subject to any disclaimer, the term of this patent is extended or adjusted under 35 U.S.C. 154(b) by 385 days.

(21) Appl. No.: 10/821,528

(22) Filed: Apr. 9, 2004

(65) Prior Publication Data

US 2005/0150414 A1 Jul. 14, 2005

(30) Foreign Application Priority Data

Apr. 11, 2003 (DE) ..... 103 16 875

(51) Int. Cl.
*F42B 27/00* (2006.01)

(52) U.S. Cl. ..... 102/487; 102/482; 102/207

(58) Field of Classification Search ..... 102/487, 102/482, 207
See application file for complete search history.

(56) References Cited

U.S. PATENT DOCUMENTS 2,282,963 A * 5/1942 Haynes ..... 290/1 R
3,342,998 A * 9/1967 Anderson ..... 290/1 R
5,635,667 A * 6/1997 Boyer et al. ..... 102/487
6,082,267 A * 7/2000 Cooper ..... 102/487
6,272,995 B1 8/2001 Schmidt et al.
6,924,571 B2 * 8/2005 Bye ..... 310/75 A
7,013,809 B1 * 3/2006 Munoz Bueno ..... 102/487

FOREIGN PATENT DOCUMENTS

| | | |
|---|---|---|
| DE | AT 391 026 B | 12/1988 |
| EP | 0 781 975 B1 | 5/1996 |
| FR | 2 745 080 A | 2/1996 |

* cited by examiner

*Primary Examiner*—Michelle Clement
(74) *Attorney, Agent, or Firm*—Scully, Scott, Murphy & Presser, P.C.

(57) ABSTRACT

A mechano-electrical fuse (10) for a hand grenade (76), which has a spring element for the storage of mechanical energy and which has a drive device connected to the spring element for driving an electrical generator (28) through mechanical energy which is stored in the spring element. The electrical generator (28) is connected through an electronic delay circuit (56) with a detonator (46), with which a booster charge (48) is associated. A barrier (40) is provided between the detonator (46) and the booster charge (48). The spring element is formed by a tensioning spring (24) associated with the handle lever (18) of the hand grenade (76). The drive device has a taut cable line (68) which is fixed at one end (70) to the generator shaft (30) and wound with a number of turns (72) around the generator shaft (30). The second end (74) of the cable line (68) is mounted to the handle lever (18). Fixed to the generator shaft (30) is a flywheel mass (32) which is fixed releasably by a shearing element (92) in a fuse housing (16) of the mechano-electrical fuse (10).

10 Claims, 2 Drawing Sheets

MECHANO-ELECTRICAL FUSE FOR A HAND GRENADE

BACKGROUND OF THE INVENTION

1. Field of the Invention

The invention concerns a mechano-electrical fuse for a hand grenade, which includes a spring element for the storage of mechanical energy. A drive device is connected to the spring element for driving an electrical generator through the mechanical energy which is stored in the spring element. The electrical generator is connected with a detonator for activation of the latter which has a booster charge associated therewith, and with a barrier arranged between the detonator and the booster charge.

2. Discussion of the Prior Art

Such a mechano-electrical fuse for a hand grenade is known from EP 0 781 975 B1. In that known mechano-electrical fuse the spring element provided for storing mechanical energy is formed by a mechanically prestressed coil spring. The handle lever of that known hand grenade is combined in per se known manner with a mechanically stressed tensioning spring. The mechanically stressed coil spring is connected to a drive device for driving an electrical generator. When the safety device for the lever is released, the coil spring is also relieved, in addition to the tensioning spring associated with the lever, whereby the electrical generator is driven. The detonator of the hand grenade is activated by means of the electrical energy produced by the electrical generator. The detonator then fires the booster charge, by means of which the explosive in the hand grenade is fired. A barrier is provided between the detonator and the booster charge in order to prevent unwanted premature firing of the booster charge.

In the case of that known hand grenade material fatigue for the coil spring, which cannot be reliably ruled out, represents a problem. This has an effect on the reliability of that hand grenade.

SUMMARY OF THE INVENTION

The object of the invention is to provide a mechano-electrical fuse for a hand grenade, which is of a comparatively simple design and which is of relatively small structural size so that it can also be installed in existing hand grenades without problem.

In accordance with the invention, in a mechano-electrical fuse of the kind set forth in the opening part of this specification, that object is attained by the features of the inventive fuse for hand grenades as detailed hereinbelow. Preferred developments and embodiments of the mechano-electrical fuse according to the invention for a hand grenade are specifically described and claimed hereinbelow.

By means of the mechano-electrical fuse according to the invention it is readily possible to satisfy current and future demands from customers, in which respect it is possible for the respectively desired delay times to be adjusted by means of the time delay circuit of the fuse according to the invention—to correspond to the respective national demands-prior to fitting of the mechano-electrical fuse in the hand grenade.

BRIEF DESCRIPTION OF THE DRAWINGS

Further details, features and advantages will be apparent from the description hereinafter of an embodiment, illustrated in the drawing, of the mechano-electrical fuse according to the invention and a hand grenade having such a mechano-electrical fuse. In the drawing.

DETAILED DESCRIPTION OF THE INVENTION

Figure 1:
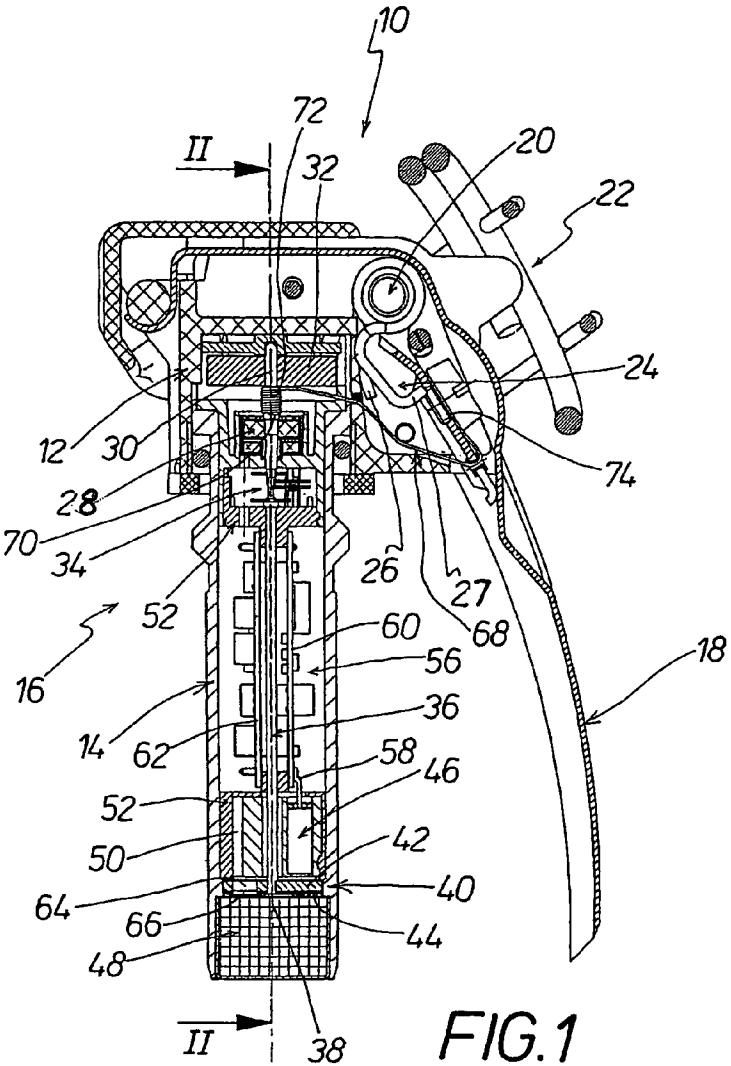
FIG. 1 is a view in section through the mechano-electrical fuse.

FIG. 1 shows a configuration of the mechano-electrical fuse 10 with a housing head 12 and a housing sleeve 14 which jointly form a fuse housing 16.

Mounted to the housing head 12 is a handle lever 18. The handle lever 18 is displaceable about a lever spindle 20 between the inactive position shown in FIG. 1 and an active position in which it pivots outwardly in the anti-clockwise direction about the lever spindle 20. The lever 18 is temporarily secured in the illustrated inactive position by means of a safety device 22. Provided between the housing head 12 and the lever 18 is a tensioning spring 24, which in the form of a cylindrical coil spring, is arranged around the lever spindle 20. The tensioning spring 24 bears with its one end portion 26 against the housing head 12 and with its second end portion 27 against the lever 18. The tensioning spring 24 is mechanically stressed in the illustrated inactive position of the lever 18. When the safety device 22 is released from the mechano-electrical fuse 10 the tensioning spring 24 can be relieved.

Disposed in the fuse housing 16 is an electrical generator 28 which for example can be a microgenerator from Kinetron-bv, 5025 RS Tilburg, Netherlands. The electrical generator 28 has a generator shaft 30 on which a flywheel mass 32 is fixed. The generator shaft 30 is connected by way of a step-down transmission 34 to a barrier displacement shaft 36. A barrier 40 is fixed to the end 38, which is remote from the step-down transmission 34, of the barrier displacement shaft 36. As can be seen from FIG. 2 in which identical details are denoted from the same references as in FIG. 1, the barrier 40 has two identical barrier discs 42 and 44 which are of different thicknesses. The barrier 40 is arranged between a detonator 46 and a booster charge 48. The booster charge 48 is located at the lower end portion of the housing sleeve 14. The detonator 46 is provided immovably in a compartment 50 which is provided in a circuit body 52. The circuit body 52 is fixed in the housing sleeve 14. It serves for supporting the barrier displacement shaft 36 and it is provided with a frame 54, as can be seen from FIG. 2.

The electrical generator 28 is connected together with the detonator 46 by way of an electronic, time delay circuit 56. That switching connection is identified by reference 58 in FIG. 1. FIG. 1 also clearly shows that the electronic time delay circuit 56 is provided on two circuit boards 60 and 62 which are mounted to the frame 54 of the circuit body 52 at a spacing from each other and facing away from each other. The barrier displacement shaft 36 extends between the mutually spaced circuit boards 60 and 62.

The time delay of the electronic time delay circuit 56 can be set in a given time window, prior to assembly of the mechano-electrical fuse 10. The time delay can be for example 4.5 to 6 seconds.

The two barrier discs 42 and 44 of the barrier 40 provided between the detonator 46 and the booster charge 48 each have an eccentric through hole 64, 66 (see FIG. 1), the holes being in mutual alignment.

FIG. 1 shows the mechano-electrical fuse 10 in its inactive position with the lever 10 in the safe condition. In that condition, the through holes 64 and 66 in the barrier discs 42 and 44 of the barrier 40 are on one side in relation to the barrier displacement shaft 36 and the detonator 46 is on the diametrally opposite side.

A cable line 68 is fixed with its one end 70 to the generator shaft 30. Adjoining that first end 70 a number of turns 72 are wound around the generator shaft 30 in closely contacting relationship. The cable line 68 extends in sealing relationship out of the housing head 12 of the mechano-electrical fuse 10, and it is fixed with its second end 74 to-the lever 18.

In the inactive, safe condition of the mechano-electrical fuse 10 the cable line 68 is provided without slack between the generator shaft 30 and the lever 18, that is to say it is taut.

When the safety device 22 is released from the mechano-electrical fuse 10, the associated tensioning spring 24 can be mechanically relieved. In that situation the lever 18 is pivoted out in FIG. 1 in the anti-clockwise direction about the lever spindle 20 and the generator shaft 30 and consequently the electrical generator 28 are caused to rotate by way of the cable line 68. The electrical generator 28 is suitably driven by means of the flywheel mass 32 fixed to the generator shaft 30, so that the electronic time delay circuit 56 is supplied with the necessary electrical power, by means of the electrical generator 28. At the same time, when the generator shaft 30 rotates, the barrier displacement shaft 36 is caused to perform a rotational movement, suitably stepped down by way of the step-down transmission 34, with the barrier 40 being rotated for example through 180° in such a way that the through holes 64 and 66 of the barrier discs 42 and 44 of the barrier 40 come into coincidence, that is to say align with the detonator 46. In that way the detonator 46 can then activate the booster charge 48.

As already mentioned the electronic time delay circuit 56 can be preset for example with a time delay of 4.5 to 6 seconds. In comparison the barrier 40 is armed for example after 3 seconds after release of the safety device 22, thus affording a reliably effective mechano-electrical fuse 10.

Figure 2:
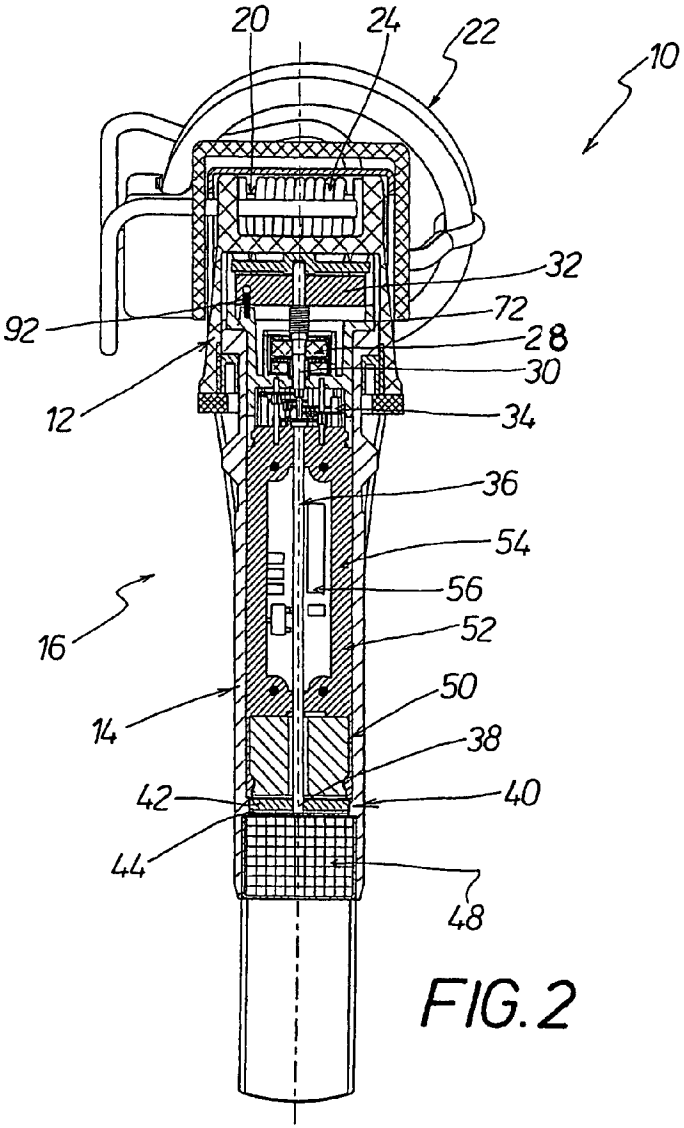
FIG. 2 is a view in section taken along section line II—II in FIG. 1 through the mechano-electrical fuse, that is to say in a section plane turned through 90.
Figure 3:
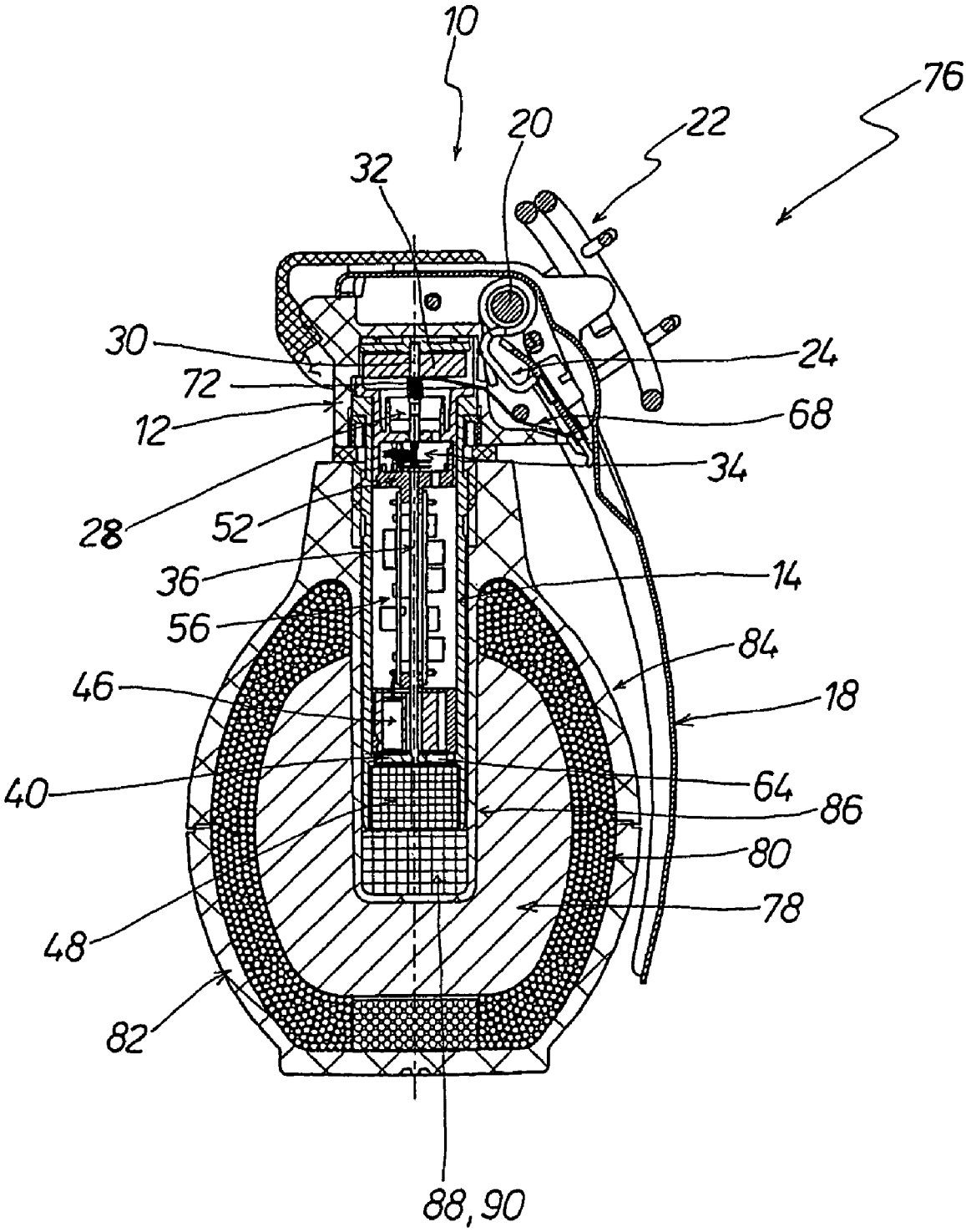
FIG. 3 is a view in section through a hand grenade provided with a mechano-electrical fuse as shown in FIGS. 1 and 2.

FIG. 3 shows a hand grenade 76 with a mechano-electrical fuse 10, as has been described hereinbefore with reference to FIGS. 1 and 2. It will be seen from FIG. 3 that the mechano-electrical fuse 10 is of such a small structure, that is to say it is of such dimensions, that the booster charge 48 is disposed virtually at the centre of the explosive 78 of a known hand grenade 76.

Reference 80 identifies a fragmentation casing of the hand grenade 76.

The hand grenade 76 has a lower housing portion 82 and an upper housing portion 84 which are connected together. The upper housing portion 84 usually has an upwardly open central portion 86 in which the mechano-electrical fuse 10 is arranged. The space 88 which remains in the central portion 86 in front of the booster charge 48 can be equipped with a further charge 90.

Identical details are denoted in FIGS., 1, 2 and 3 by the same respective references so that there is no need for all features to be described in detail again with reference to the Figures.

FIG. 2 also clearly shows a shearing element 92, by means of which the flywheel mass 32 is releasably connected to the fuse housing 16 or the housing head 12 thereof in the inactive rest condition, that is to say in the condition of the lever 18, in which it is secured by the safety device 22.

List of references

10 mechano-electrical fuse
12 housing head (of 16)
14 housing sleeve (of 16)
16 fuse housing
18 lever (of 10)
20 lever spindle (for 18)
22 safety device (for 16)
24 tensioning spring (between 12 and 18)
26 first end portion (of 24 at 12)
27 second end portion (of 24 at 18)
28 electrical generator (in 12)
30 generator shaft (of 28)
32 flywheel mass (at 30)
34 step-down transmission (between 30 and 36)
36 barrier displacement shaft (for 40)
38 end (of 36 for 40)
40 barrier (between 46 and 48)
42 barrier disc (of 40)
44 barrier disc (of 40)
46 detonator (of 10)
48 booster charge (of 10)
50 compartment (in 52 for 46)
52 circuit body (for 56)
54 frame (of 52).
56 electronic time delay circuit (at 54)
58 switching connection (between 56 and 46)
60 circuit body (of 56)
62 circuit body (of 56)
64 through hole (in 42)
66 through hole (in 44)
68 cable line (between 30 and 18)
70 first end (of 68 on 30)
72 turns (at 70 on 30)
74 second end (of 68 at 18)
76 hand grenade
78 explosive (of 76)
80 fragmentation casing (of 76)
82 lower housing portion (of 76)
84 upper housing portion (of 76)
86 central portion (of 84 for 10)
88 space (in front of 48 in 86)
90 charge (in 88)
92 shearing element

The invention claimed is:

1. A mechano-electrical fuse for a hand grenade (76), comprising a spring element for the storage of mechanical energy, and a drive device connected to the spring element for driving an electrical generator (28) through mechanical energy which is stored in the spring element, wherein the generator (28) is connected together with a detonator (46) for the activation thereof, with which a booster charge (48) is associated, wherein a barrier (40) being provided between the detonator (46) and the booster charge (48), wherein the spring element comprises a tensioning spring (24) operatively associated with a handle lever (18) of the hand grenade (76), and the drive device includes a cable line (68) which is fixed with one end thereof (70) to a shaft (30) of the generator (28) and is wound with a number of turns (72) around the generator shaft (30) and is mounted with a second end (74) thereof remote therefrom to the lever (18), and fastened to the generator shaft (30) is a flywheel mass (32) which is releasably fastened in a housing (16) of the fuse by a shearing element (92).

2. A mechano-electrical fuse according to claim 1 wherein the electrical generator (28) is connected to the detonator (46) through an electronic time delay circuit (56).

3. A mechano-electrical fuse according to claim 2 wherein the time delay of the time delay circuit (56) is adjustable within a specialized time window.

4. A mechano-electrical fuse according to claim 2 wherein the time delay circuit (56) is arranged on a circuit body (52) which is provided with a compartment (50) in which the detonator (46) is immovably arranged.

5. A mechano-electrical fuse according to claim 4 wherein the time delay circuit (56) is located on two circuit boards (60, 62), and the circuit body (52) has a frame (54) on which the two circuit boards (60,62) are mounted facing away from each other and being spaced from each other.

6. A mechano-electrical fuse according to claim 5 wherein the generator shaft (30) is connected by a step-down transmission (34) to a barrier displacement shaft (36), the barrier (40) being fixed to an end (38) of the barrier displacement shaft which is remote from the step-down transmission (34).

7. A mechano-electrical fuse according to claim 6 wherein the barrier displacement shaft (36) extends through the circuit body (52) and the detonator compartment (50) between the two circuit boards (60, 62).

8. A mechano-electrical fuse according to claim 6 wherein the barrier (40) has at least one barrier disc from which the barrier displacement shaft (36) centrally projects, and which barrier disc has an eccentrically located through hole which in the armed position of the hand grenade (76) is aligned with the detonator (46).

9. A mechano-electrical fuse according to claim 8 wherein the barrier (40) has two barrier layers (42 and 44) of conforming configuration and of differing thicknesses.

10. A mechano-electrical fuse according to claim 9 wherein the barrier disc layer (42) facing towards the detonator (46) is of a greater wall thickness than the barrier disc layer (44) which is distant from the detonator (46).

* * * * *